United States Patent [19]

Slack

[11] Patent Number: 4,728,303

[45] Date of Patent: Mar. 1, 1988

[54] TEMPERATURE SENSING POWER PLUG AND METHOD OF MANUFACTURE

[75] Inventor: Douglas J. Slack, Smithfield Plains, Australia

[73] Assignee: Texas Instruments Incorporated, Dallas, Tex.

[21] Appl. No.: 416,523

[22] Filed: Sep. 9, 1982

Related U.S. Application Data

[63] Continuation of Ser. No. 159,579, Jun. 16, 1980, abandoned.

[30] Foreign Application Priority Data

Jun. 15, 1979 [AU] Australia ..... PD9222

[51] Int. Cl.[4] ..... H01R 13/11

[52] U.S. Cl. ..... 439/620

[58] Field of Search ..... 339/147 P, 195, 196, 339/276 T

[56] References Cited

U.S. PATENT DOCUMENTS

| | | | |
|---|---|---|---|
| 2,508,637 | 5/1950 | Bolesky | 339/196 A |
| 2,830,166 | 4/1958 | Loomis | 339/147 P |
| 3,193,792 | 7/1965 | Lhea, Jr. | 339/276 T |
| 3,668,615 | 6/1972 | Bury | 339/276 T |

FOREIGN PATENT DOCUMENTS

| | | | |
|---|---|---|---|
| 7506090 | 11/1976 | Netherlands | 339/147 P |

*Primary Examiner*—Joseph H. McGlynn

*Attorney, Agent, or Firm*—James P. McAndrews; John A. Haug; Melvin Sharp

[57] ABSTRACT

A temperature sensitive probe plug in which connector wires are crimped to the terminals of the plug. The power lead wires can be attached to the connector wires by crimping connectors, the base of the plug beneath the crimping connectors being shaped as anvil portions so that it is merely necessary to insert the wires into the crimping connectors and the application of a crimping tool will crimp the connectors about the wires by the reaction of the tool against the anvil.

3 Claims, 2 Drawing Figures

TEMPERATURE SENSING POWER PLUG AND METHOD OF MANUFACTURE

This application is a continuation of application Ser. No. 159,579, filed June 16, 1980, now abandoned.

This invention relates to a temperature sensing probe plug and method of manufacture and in particular it relates to a plug of the type which engages an electric frypan or other equipment which requires to have power supplied thereto but includes a probe for sensing the temperature of the frypan or other appliance.

It is customary in this type of plug to have a moulded body which has at one end a probe which engages the appliance and also has a pair of terminals which engage pins on the appliance to transfer the power, the probe acting as the earth connection for a three-wire system, the plug having the necessary switching means in it actuated by the temperature sensing element of the probe to regulate the switching of the power for temperature maintenance.

It is customary in probe plugs of this type to have a relatively long lead by means of which the power is supplied and to terminate the lead in the body of the plug itself by connecting the conductors of the lead to members in the plug which themselves connect to the probe and terminals and this is customarily effected by welding, or screw or gripping devices which make a firm connection between the conductors of the lead and the members which form part of the terminal and probe assembly.

It is an object of the present invention to provide an improved method of joining the conductors of a lead to the probe and terminals of the plug and it is a further object to so arrange the plug that the attachment of the conductors within the plug can be effected with a minimum of effort but with a secure connection.

According to the present invention crimping connectors are used to join the terminal and probe connections to the conductors of the power lead and to achieve this the probe and the terminal each have fixed to them wires which extend from the probe and terminals to the respective crimping connectors and which wires may themselves be crimped to the terminals and the probe but preferably are welded to the probe.

In order to more fully describe the invention reference will now be made to the accompanying drawings in which.

Figure 1:
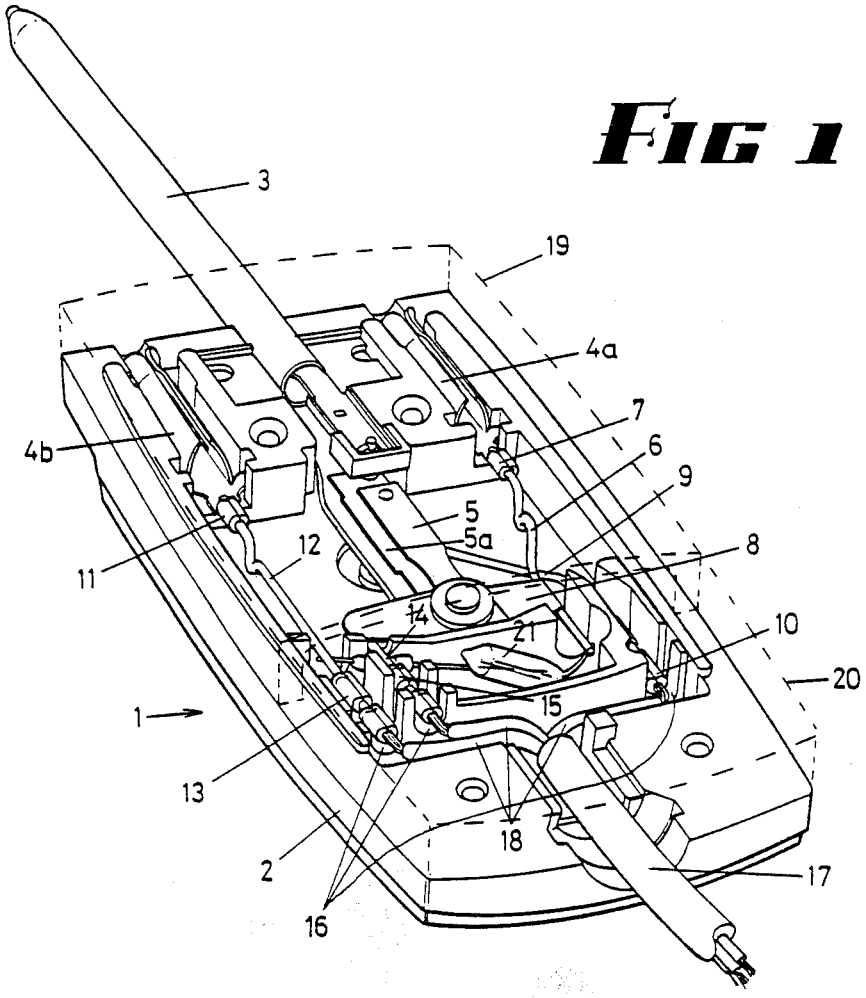
FIG. 1 is a view of the probe plug with the base removed.

The probe plug 1 has a cover 2, the cover carrying the probe 3 and the terminals 4*a* and 4*b* to engage the pins on the appliance. The probe 3 includes the temperature sensitive element which actuates the contact switch element 5*a* which interrupts the lines 6 to the terminal 4*a*, the line 6 being a wire crimped by crimp element 7 to the terminal 4*a* and welded or otherwise connected to member 8 connected to one contact of switch element 5.

The earth of the probe is connected by wire 9 to a crimp element 10. Terminal 4*b* has crimped thereto by crimp element 11 the wire 12 which is also engaged in crimp element 13. The other contact of switch 5 is connected by wire 14 to crimp element 15 and carries the active side of the power.

Figure 2:
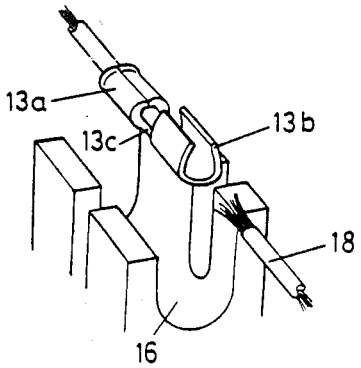
FIG. 2 is an enlarged partial view of a connector and anvil.

Crimp elements 10, 13 and 15 are each of the double end type, having as shown in FIG. 2, which shows as an example crimp element 13, a portion 13*a* connected to portion 13*b* by a connector 13*c*. On manufacture of the plug, the wires 6 and 12 are crimped to the connectors 4*a* and 4*b*, and wires 9 and 12 to the respective portions 10*a* and 13*a* of the crimp elements 10 and 13. Also wire 14 is crimped to crimp portion 15*a*. The other end of wire 6 is welded to member 8.

The cover 2 has at the position of crimp connectors 10, 13 and 15 a recess formed as an anvil 16, so that the crimp portions 10*a*, 10*b*, 13*a*, 13*b*, 15*a* and 15*b* will be received in the recess above the anvil 16.

The power cord 17 can then be attached, either at the production stage or later, even by a retailer or installer. To attach the power cord 17 each of the leads 18 has its wires bared, and these bared ends are then inserted into the respective crimp portions 10*b*, 13*b* and 15*b*. A crimping punch (not shown) is then applied to the portions 10*b*, 13*b*, and 15*b* and the crimped connection made by crimping the portion against the anvil 16.

The base of the body of the plug is provided in two portions, the portion 19 being attached to cover the body of the plug except that portion of the cover 2 which leaves the crimping connectors exposed. Thus the portion 20 of the base then need only be removed to attach the power cord 17.

The ends of the wires remote from the probe and terminals are thus positioned in open-topped anvil sockets in the body adjacent to the area where the conductors of the power lead terminate within the body and a crimping connector is then attached to these remote ends of each of the wires to be disposed within the open-topped anvil sockets and the wires are locked to the forward end parts of the crimping connectors by the application of a crimping tool.

As a modification however the wires can have the crimping connectors affixed to them prior to the terminals and probe being positioned in the body where it is desired to preform the terminals and probe with the connecting wires and the crimping connectors.

To then connect the conductors of the lead to the respective crimping connectors it is only necessary to place the ends of the conductors into the rearward part of the crimping connectors which at that stage are open upwardly to allow the wires to be positioned and to then apply to that part of each crimping connector a crimping tool which shapes the crimping connector in the anvil socket to firmly clamp the connector to the conductor.

To enable this to be done the phenolic body is recessed at the terminal points of the conductors of the lead to form the anvil sockets and as will be known at that stage the part of the crimping connector which engages the wire is in the form of an open U-shaped member but when the crimping tool is forced down on it the projecting edges of the U-shaped member are forced inwardly towards each other and down by the shape of the crimping tool to form a highly effective lock between the crimping connector and the conductors of the lead.

As the sockets are formed in the body they can be closed after crimping the wires to the connectors by either applying a cover member to the body or by placing a moulding or decal over the area where the anvil sockets are positioned.

Thus according to a convenient form of the invention a phenolic or similar body is moulded which has an open top which may be closed by a similarly shaped body inverted over the first body when the assembly is complete, but the phenolic body has positioned in it firstly the probe which is provided with an earthling connection wire extending one of the crimping connectors and with temperature sensitive switching means which connect by means of a wire to one of the terminals and to a wire which has on it a crimping connector which connects to a live conductor which is to be switched, the other terminal connecting to the third conductor of the power lead.

The device can of course include a neon indicator 21 in a normal way bridged between active and neutral of the power supply to the probe.

The method of applying the invention consists in mounting the terminals and the terminal wires as well as the probe and the probe wire in sockets in the phenolic body whereby to locate the crimping connectors in the anvil sockets formed in the body near the rear end and to apply the base to the body to complete the assembly, after which the probe plug is ready for sale and can either be supplied in the form where no power lead is attached to it or it can be supplied with a power lead which however is in that case permanently joined in the plug by the crimping connectors having been closed tightly on to the conductors of the supply lead by applying the crimping tool in conjunction with the anvil sockets which hold the crimping connectors, the body being of course shaped to have slots or spaces to guide the end of the crimping tool into correct association with the crimping connectors in the anvil sockets.

As said the plug can be sold without applying the power lead thereto and when at the destination it is necessary to connect a power lead to the plug, this can readily be done by removing the small portion 20 of the top of the plug body to give access to at least that part of the body immediately adjacent to the anvil sockets and then applying the lead by positioning the conductors of the lead in the anvil sockets and crimping in the described manner.

From the foregoing it will be realised that a greatly simplified construction results firstly because the connection between the probe and the terminals and the conductors of the lead is effected through simple wires attached to the probe and the terminals which extend to the crimping area and which can either carry the crimping connectors in readiness for the connectors to be crimped to the wires or precrimping of the connectors can take place so that the wires when positioned locate the crimping connectors at the site where the conductors of the power lead can be engaged in the crimping connectors and tightly crimped by the application of a crimping tool.

It will be realised that one of the advantages of the present invention is whereas in some countries such control plugs need only be fitted with a single insulation, unsheathed, two-core supply cord, Australian and European controls require a sheathed three-core supply cord which makes a much more bulky article that is difficult and awkward to handle during assembly.

By use of the present invention the assembly of the plug can be completed excepting for the member which must expose the end of the plug to allow the conductors to be positioned and the lead clamped to the end of the plug prior to crimping the conductors to the connectors.

The control plug which forms this invention and which has a rigid lead frame assembly lends itself to mechanization and to easier assembly and handling during assembly.

I claim:

1. An easily shipped subassembly for a temperature sensitive electrical control to be completed after shipment where the control is adapted to be releasably connected to terminals of a home appliance to regulate electrical operation of the appliance in accordance with appliance temperature, the subassembly comprising a base of rigid electrical insulating material, temperature sensitive means carried on as first portion of the base to be disposed in heat-sensing relation to the appliance when the control is releasably connected to the appliance terminals, a pair of electrical contacts carried on the first portion of the base to be electrically connected to an electrical power source, and electrical switch means carried on the first portion of the base to be responsive to the temperature sensitive means for opening and closing an electrical circuit between the contacts to regulate appliance operation in response to selected changes in appliance temperature, characterized in that, a pair of wires are electrically coupled to the respective contacts and extend from the first portion of the base to locate first ends of the respective wires over another selected portion of the base for use in connecting the contacts to the power source, a pair of electrically conductive metal connectors each having a U-shaped crimpable portion extending from one end of the connector are electrically connected to said one ends of the respective wires so that the U-shaped crimpable connector portions extend from the wires over said other selected portions of the base, the base has U-shaped anvils integrally formed of the rigid electrically insulating base material upstanding from said other selected base portions receiving the respective U-shaped crimpable portions of the connectors in nested relation therein, first electrically insulating cover means are secured to the base over the first portion of the base enclosing the contacts, temperature sensitive means and switch means during shipment of the subassembly and thereafter while leaving the U-shaped crimpable connector portions accessible to subsequently receive ends of respective conductors from a power source therein to be crimped into engagement with the respective conductor ends by user deformation of the crimpably connector portions against the integral base anvils, and additional electrically insulating cover means are detachably secured to the base over the other base portions to accommodate and enclose and protect said crimpable connector portions before they are crimped during shipment of the subassembly, to be removable to allow crimping of the connector portions against the integral anvils after shipment, and to be again secured to the base thereafter to enclose the crimped connector portions and said conductor ends.

2. A control subassembly as set forth in claim 1 further characterized in that, the base has an additional pair of U-shaped anvil portions upstanding from the base, the connectors each have an additional U-shaped connector portion disposed on the respective additional base anvil portions in nested relation thereto and the respective wires are electrically connected to the respective connectors by having said additional U-shaped connector portions crimped to the wires against the additional anvils.

3. A control as set forth in claim 1 wherein said wires coupled to the respective contacts are rigid and cooperate with the connectors to extend from under the first cover means and dispose the U-shaped crimpable portions of the connectors precisely over anvil portions integrally formed in the base under the additional cover means.

* * * * *